United States Patent [19]

Baker et al.

[11] 3,942,445

[45] Mar. 9, 1976

[54] HIGH ALTITUDE FRICTION IGNITER

[75] Inventors: Charles Baker, Avoca; Benjamin F. Harkness, Odon; Alfred W. Norris, Bloomington, all of Ind.

[73] Assignee: The United States of America as represented by the Secretary of the Navy, Washington, D.C.

[22] Filed: Sept. 18, 1974

[21] Appl. No.: 507,038

[52] U.S. Cl. ..... 102/70 R; 102/70 F; 149/22; 149/29; 149/44; 149/82

[51] Int. Cl.[2] ..... F42C 7/00

[58] Field of Search ..... 102/70 R, 70 F, 37.8, 35, 102/86.5; 149/22, 29, 82, 44

[56] References Cited

UNITED STATES PATENTS

| | | | |
|---|---|---|---|
| 1,206,827 | 12/1916 | Fairburn | 149/29 |
| 1,771,455 | 7/1930 | Wiley | 102/70 F |
| 2,170,815 | 8/1939 | Eroe | 102/70 F |
| 2,391,823 | 12/1945 | Edmands | 102/70 F |
| 3,617,403 | 11/1971 | Johnson | 149/22 X |

FOREIGN PATENTS OR APPLICATIONS

| | | | |
|---|---|---|---|
| 19,096 | 9/1914 | France | 102/35 |

*Primary Examiner*—Samuel W. Engle
*Assistant Examiner*—Harold Tudor
*Attorney, Agent, or Firm*—R. S. Sciascia; Paul S. Collignon

[57] ABSTRACT

A friction igniter assembly for high altitude operation having a pull wire coated with a scratch sensitive composition which is moved through a chlorate composition. The scratch sensitive composition containing red phosphorus reacts with the chlorate to provide a flash which transfers ignition to an adjacent boron-lead dioxide composition. The boron-lead dioxide composition is the main igniting charge and provides an intense output of heat in a very short time for igniting a pyrotechnic composition.

2 Claims, 1 Drawing Figure

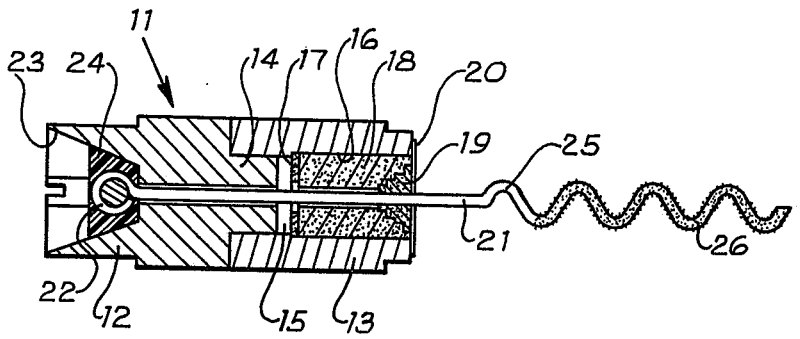
11
23
24
14
17
16
18
20
19
25
21
26
22
12
15
13

HIGH ALTITUDE FRICTION IGNITER

BACKGROUND OF THE INVENTION

The present invention relates to an igniter assembly and more particularly to an igniter assembly that is highly reliable up to altitudes of 100,000 feet.

Present igniter assemblies used by the military work satisfactory at altitudes up to about 12,000 feet, however, above 12,000 feet their performance degrade and at about 40,000 feet, presently available igniters will not sustain ignition. Various military operations require the use of igniters at altitudes considerably greater than 40,000 feet and, heretofore, none has been available that would provide reliable performance.

SUMMARY OF THE INVENTION

The present invention relates to a high altitude friction igniter having a housing comprised of two sections that are movable relative to one another. One section contains first and second igniter compositions and a wire having a red phosphorus scratch mixed on one end portion passes through the two igniter compositions and is attached to the second section. The first igniter composition is a chlorate composition and the second igniter composition is a boron-lead dioxide composition. Movement of one section relative to the other section causes a phosphorus-chlorate reaction which provides a flash to transfer ignition to the boron-lead dioxide composition. The boron-lead dioxide is the main igniting charge and provides an intense output of heat in a very short time.

BRIEF DESCRIPTION OF THE DRAWING

The FIGURE of the drawing is a longitudinal sectional view of a preferred embodiment of the invention.

DESCRIPTION OF THE PREFERRED EMBODIMENT

Referring now to the drawing, there is shown an igniter housing 11 consisting of two sections 12 and 13. Section 12 is provided with a reduced diameter portion 14 that slip-fits into a central bore 15 of section 13 so that sections 12 and 13 can move relative to one another. By way of example, housing 11 might have section 12 attached to a piston mounted within a case of a decoy flare, and movement of the piston causes movement of both sections 12 and 13. When the piston reaches the end of the case, it is stopped, along with section 12, however section 13 is separated from section 12.

Section 13 is provided with a second central bore 16, only slightly larger in diameter than bore 15. and a thin washer 17 is positioned in bore 16, adjacent bore 15. An igniter composition 18 is pressed into bore 16 and igniter composition 18 is provided with a plurality of stepped counterbores that are filled with a second igniter composition 19. A closing disk 20 is cemented to section 13 to retain the igniter compositions in bore 16. Igniter composition 18 is comprised, by weight, of 89 parts of potassium chlorate, 10 parts of charcoal and 1 part of dextrin. In igniter compositions mixed and tested at the Naval Ammunition Depot, Crane, Indiana, it has been determined that the following tolerances can be used: for potassium chlorate, plus or minus 1.8 parts; for charcoal, plus or minus 0.5 part; and for dextrin, plus or minus 0.1 part.

Igniter composition 19 is comprised, by weight, of 46.6 percent of lead dioxide, 20 percent of boron and 33.4 percent of a binder, such as a cellulose nitrate-camphor binder dissolved in acetone. The cellulose nitrate is plasticied with camphor and is more fully described in Military Specification MIL-B-10854. By way of example, the binder solution might be 8 parts, by weight, of cellulose nitrate-camphor which has been dissolved in 92 parts of acetone. In igniter compositions 19 mixed and tested at the Naval Ammunition Depot, Crane, Ind., it has been determined that the following tolerances can be used: for lead dioxide, plus 0, minus 3 parts; for boron, plus 3, minus 0 parts, and for the binder, plus 6, minus 0 parts.

As shown in the drawing, a friction wire 21 is passed through igniter compositions 18 and 19, and a loop 22 is formed on one end and soldered in a conical cavity 23 in section 12. A portion of cavity 23 is then filled with an epoxy filler 24 which is then cured thereby securely fastening wire 21 with section 12. The end of wire 21 that extends outside housing 11 is provided with a plurality of undulations 25 which are coated with a scratch mix 26. The scratch mix is comprised, by weight, of 50 parts of red phosphorus, 35 parts of a moisture-proof varnish and 15 parts of an elastomeric adhesive more fully described in Federal Specification MM-A-1617. The elastomeric adhesive is mixed with equal parts of paint thinner, such as volatile mineral spirits, and the varnish is also thinned with paint thinner by mixing, by weight, 65 parts of varnish and 35 parts of paint thinner.

In operation, relative movement between sections 12 and 13 of housing 11 causes friction wire 21 to move through igniter composition 18 and the red phosphorus on scratch mix 26 reacts with the potassium chlorate to provide a flash. This flash ignites the boron-lead dioxide composition, which is the main igniting charge and provides an intense output of heat in a very short time. By way of example, section 13 might be retained in a bore in a pyrotechnic candle and ignition of the boron-lead dioxide composition will ignite the pyrotechnic candle.

Obviously many modifications and variations of the present invention are possible in the light of the above teachings. It is therefore to be understood that within the scope of the appended claims the invention may be practiced otherwise than as specifically described.

We claim:

1. A high altitude friction igniter comprising, a housing having first and second sections adaptable for movement relative to one another, a first igniter composition contained within said first section comprised, by weight, of between 87.2 and 90.8 percent of potassium chlorate, between 9.5 and 10.5 percent of charcoal and between 0.9 and 1.1 percent of dextrin, a second igniter composition contained within said first section adjacent said first igniter composition, said second igniter composition comprised, by weight, of between 43.6 and 46.6 percent of lead dioxide, between 20 and 23 percent of boron and between 33.4 and 39.4 percent of binder, and a friction wire passing through said first and second igniter compositions and having both ends thereof extending beyond said compositions, one end of said friction wire being attached to said second section, and a length of wire extending beyond said housing having a coating of scratch mix comprised, by weight, of between 48 and 52 percent of red phosphorus, between 33 and 37 percent of a varnish composition and between 13 and 17 percent of an adhesive composition, whereby relative movement between said first and second sections causes engagement of said scratch mix with said first igniter composition to produce a flash of flame which ignites said second igniter composition.

2. A high altitude friction igniter as set forth in claim 1 wherein said length of wire extending beyond said housing has a plurality of undulations coated with said scratch mix.

* * * * *